United States Patent [19]

Erickson

[11] Patent Number: 4,781,036

[45] Date of Patent: Nov. 1, 1988

[54] PIERCED-EAR EARRING WITH CHANGEABLE DECORATIVE EARRING ELEMENTS

[76] Inventor: Dolores Erickson, 16 Bel Aire Dr., Madison, Wis. 53713

[21] Appl. No.: 919,667

[22] Filed: Oct. 16, 1986

[51] Int. Cl.[4] ..... A44C 7/00

[52] U.S. Cl. ..... 63/12; 63/29.1; 128/330

[58] Field of Search ..... 63/12, 13, 29; 128/329, 128/330

[56] References Cited

U.S. PATENT DOCUMENTS

| | | | |
|---|---|---|---|
| 2,552,151 | 5/1951 | Cohen | 63/12 |
| 2,568,207 | 9/1951 | Spicher | 128/329 |
| 2,642,872 | 6/1953 | Parker | 63/12 |
| 2,713,863 | 7/1955 | Handerson | 63/12 |
| 3,187,751 | 6/1965 | Coren | 63/12 |
| 3,504,507 | 4/1970 | Ferro | 63/29 R |
| 4,353,225 | 10/1982 | Rogers | 63/13 |

*Primary Examiner*—Richard J. Johnson

*Attorney, Agent, or Firm*—Keith D. Beecher

[57] ABSTRACT

A pierced-ear earring which comprises a post threaded at both ends to be inserted into the ear lobe of the wearer by a conventional ear piercing device, a front cap which is threaded to one end of the post prior to firing the post through the ear lobe, and a rear cap which is threaded to the other end of the post after it has been inserted through the ear lobe. In use, the front cap is removed from the post and replaced by decorative earring elements of different shapes and colors. The earring elements are removed and the front cap is again screwed onto the post.

4 Claims, 1 Drawing Sheet

3 3

PIERCED-EAR EARRING WITH CHANGEABLE DECORATIVE EARRING ELEMENTS

BACKGROUND OF THE INVENTION

Pierced earrings are known which comprise a post which extends through the wearer's ear lobe, and to which a variety of different ornamental earring elements may be selectively threaded. Such earrings are described, for example, in Ferro U.S. Pat. No. 3,504,507.

The pierced-ear earring of the present invention, however, constitutes an improvement over the Ferro type of pierced-ear earring in that the assembly of the invention lends itself readily for insertion into the ear lobe from the front by a conventional ear piercing device gun, as distinguished from Ferro's ear piercing from the rear.

The pierced-ear earring of the invention may be sold as a kit at ear piercing establishments; the kit consisting of the post and the front and back caps described above, together with an assortment of screw-on earring decorative elements of different shapes and colors.

DETAILED DESCRIPTION OF THE ILLUSTRATED EMBODIMENTS

Figure 1:
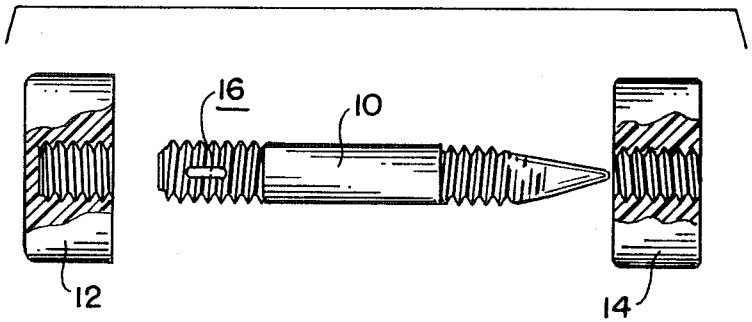
FIG. 1 is a side view showing the post and end caps of the pierced-ear earring of the invention in one of its embodiments.

The pierced-ear earring assembly of the embodiment of the invention shown in FIG. 1, includes a post 10 which is pointed at one end. A front cap 12 is screwed onto the other end of post 10, and the resulting subassembly is then fired through an ear lobe of the prospective wearer by means of a usual ear piercing device as disclosed in U.S. Pat. No. 4,164,224.

Figure 2:
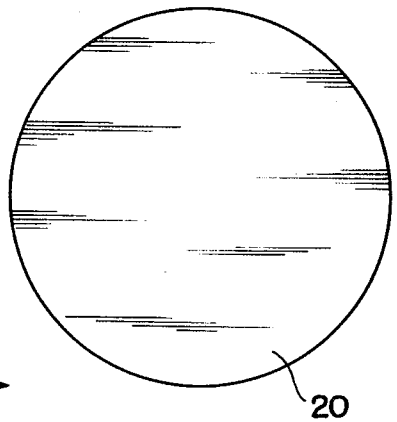
FIG. 2 is a front view of a particular decorative earring element adapted selectively to be screwed onto the post of FIG. 1.
Figure 3:
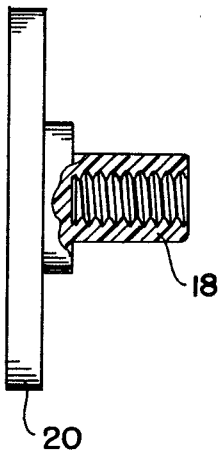
FIG. 3 is a side view of the earring element of FIG. 2.

After the post 10 has been inserted through the ear lobe, a rear cap 14 is threaded onto the pointed end of the post. The cap 14 has a thickness sufficient to assure that the pointed end of post 10 will not protrude beyond the cap. Subsequently, the cap 12 may be unscrewed from the post, and replaced by a decorative earring element, such as element 20 of FIGS. 2 and 3. Element 20 is provided with a bushing 18 which is threadably received on the front end of the post. A hole 16 may be provided in the front end of the post to receive wire-hanging type earring elements, if so desired.

Figure 4:
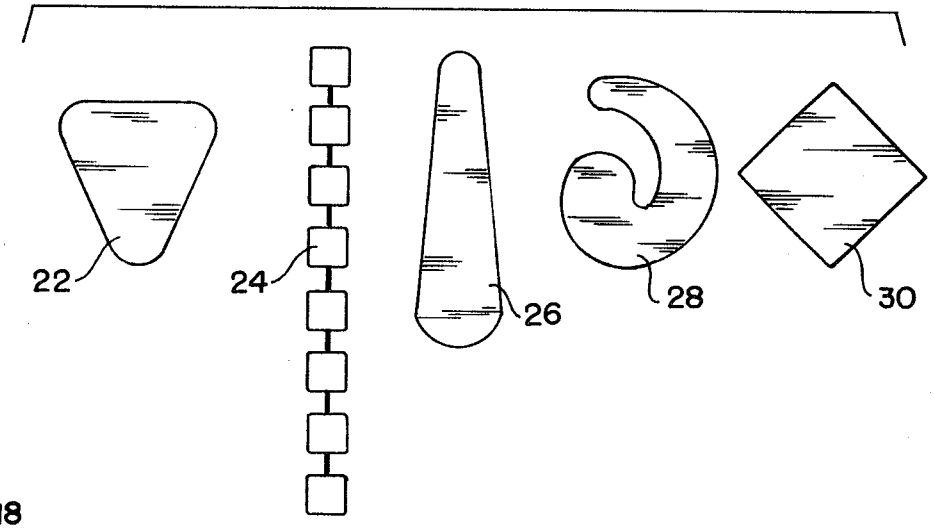
FIG. 4 illustrates a variety of decorative earring elements of different shapes and sizes which may be selectively screwed onto the post of FIG. 1.

Other decorative elements, such as designated 22, 24, 26, 28 and 30 in FIG. 4 may be selectively threaded onto the front end of post 10 at the option of the wearer. Decorative element 24 may include, for example, a number of rhinestones linked to one another. The other decorative elements may be of different selected shapes, sizes and colors.

The invention provides, therefore, a simple pierced earring assembly by which the wearer may selectively wear a number of different decorative earring elements, depending upon the mood of the wearer or the occasion.

It will be appreciated that while particular embodiments of the invention have been shown and described, modifications may be made. It is intended in the claims to cover all modifications which come within the true spirit and scope of the invention.

I claim:

1. A pierced-ear earring assembly comprising: a post having a pointed end to be fired through an ear lobe of the wearer by a spring biased ear-piercing device; a generally cylindrically shaped front cap configured to be supported and guided within said ear piercing device removably attached to one end of said post; a rear cap constructed to be removably attached to the other end of the post after it has been fired through the ear lobe; and a decorative earring element constructed to be removably attached to said one end of said post after said front cap has been removed.

2. The pierced-earring assembly defined in claim 1, in which the post is threaded at each end, and in which the front and rear caps are constructed to be threaded to the post.

3. The pierced-earring assembly defined in claim 2, in which the earring element is constructed to be screwed to said one end of the post.

4. The pierced-earring assembly defined in claim 1, in which said one end of the post has a hole extending therethrough for receiving wire-mounted earring elements.

* * * * *